US008730291B2

(12) United States Patent
Inagaki

(10) Patent No.: US 8,730,291 B2
(45) Date of Patent: May 20, 2014

(54) IMAGE FORMING APPARATUS

(75) Inventor: Yoshihiro Inagaki, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 698 days.

(21) Appl. No.: 12/619,747

(22) Filed: Nov. 17, 2009

(65) Prior Publication Data

US 2010/0124440 A1 May 20, 2010

(30) Foreign Application Priority Data

Nov. 19, 2008 (JP) ..... 2008-295337

(51) Int. Cl.
*B41J 15/14* (2006.01)
*B41J 27/00* (2006.01)

(52) U.S. Cl.
USPC ..... 347/258; 347/244

(58) Field of Classification Search
USPC ..... 347/244, 258
See application file for complete search history.

(56) References Cited

U.S. PATENT DOCUMENTS

| | | | | |
|---|---|---|---|---|
| 6,088,164 | A | 7/2000 | Fukasawa | |
| 6,717,606 | B2 * | 4/2004 | Masuda | 347/244 |
| 7,286,259 | B2 * | 10/2007 | Ohno et al. | 358/1.8 |
| 7,486,306 | B2 * | 2/2009 | Tsujino et al. | 347/224 |
| 7,719,560 | B2 * | 5/2010 | Koizumi et al. | 347/238 |
| 7,746,369 | B2 * | 6/2010 | Nomura et al. | 347/225 |
| 7,777,958 | B2 * | 8/2010 | Shimmo et al. | 359/622 |
| 7,956,885 | B2 * | 6/2011 | Nomura et al. | 347/244 |
| 8,014,072 | B2 * | 9/2011 | Nagata | 359/621 |
| 8,022,975 | B2 * | 9/2011 | Sowa et al. | 347/238 |

FOREIGN PATENT DOCUMENTS

| | | | |
|---|---|---|---|
| JP | 10-309826 | A | 11/1998 |
| JP | 2002-331702 | A | 11/2002 |

* cited by examiner

*Primary Examiner* — Uyen Chau N Le
*Assistant Examiner* — John M Bedtelyon
(74) *Attorney, Agent, or Firm* — Buchanan Ingersoll & Rooney PC

(57) ABSTRACT

An image forming apparatus wherein a photosensitive drum is located such that its circumferential surface is exposed to light at a position between an image surface of light that is emitted from an LED at a distance of a half of a pitch of a plurality of rod lenses from a first rod lens of the plurality of rod lenses and that passes through the first rod lens and an image surface of light that is emitted from an LED at a distance of the pitch of the plurality of rod lenses from a second rod lens of the plurality of rod lenses and that passes through the second rod lens.

15 Claims, 14 Drawing Sheets

IMAGE FORMING APPARATUS

This application is based on a Japanese patent application No. 2008-295337 filed on Nov. 19, 2008, the content of which is incorporated herein by reference.

BACKGROUND OF THE INVENTION

1. Field of the Invention

The present invention relates to an image forming apparatus, and more particularly to an image forming apparatus wherein a photosensitive drum is exposed to light so as to obtain an electrostatic latent image thereon.

2. Description of Related Art

As conventional image forming apparatuses, for example, an image forming apparatus disclosed by Japanese Patent Laid-Open Publication No. 10-309826 (Reference 1) and an image forming apparatus disclosed by Japanese Patent Laid-Open Publication No. 2002-331702 (Reference 2) are well known. In the image forming apparatus disclosed by Reference 1, in order to form an electrostatic latent image, light emitted from an LED array is imaged on the circumferential surface of a photosensitive drum by use of a lens array. This lens array is composed of a plurality of rod lenses that are arranged in two lines extending in a main-scanning direction.

In the image forming apparatus disclosed by Reference 1, however, it is very difficult to speed up the formation of an electrostatic latent image. More specifically, since the rod lenses are arranged in two lines extending in the main-scanning direction, most part of the light emitted from the LED array does not enter into the rod lenses and leaks out from the effective area of the rod lenses, with respect to a sub-scanning direction. Accordingly, the quantity of light used to form an electrostatic latent image is small, and speedy formation of an electrostatic latent image is difficult.

In the image forming apparatus disclosed by Reference 2, a lens array is composed of rod lenses that are arranged in three lines extending in a main-scanning direction. Further, an LED array is displaced from the center of the lens array in a sub-scanning direction so that the beam profile during scanning on the photosensitive drum will not vary.

In the image forming apparatus disclosed by Reference 2, however, there is a problem that an electrostatic latent image formed therein has poor contrast. More specifically, since the LED array is displaced from the center of the lens array in the sub-scanning direction, the angle of field of light to the rod lenses in the line farthest from the LED array is larger than the angle of field of light to the rod lenses in the other two lines. Then, also suffering from the effect of field curvature of the rod lenses, the image points of the rod lenses in the line farthest from the LED array are displaced from the image points of the rod lenses in the other two lines, and consequently, the electrostatic latent image formed thereby has poor contrast.

SUMMARY OF THE INVENTION

An object of the present invention is to provide an image forming apparatus wherein an electrostatic latent image of high quality can be formed at a high speed.

In order to attain the object, an image forming apparatus according to one aspect of the present invention comprises: a photosensitive member; a light source comprising a plurality of light emitting elements arranged in a line extending in a main-scanning direction; and a lens array comprising a plurality of lenses that are arranged in three lines extending in the main-scanning direction such that the lenses of the neighboring lines are offset by one another, the lens array being for imaging light emitted from the light source to form an erect equi-magnified image on a surface of the photosensitive member, and in the image forming apparatus, the light source is located above a substantially center of the lens array in the sub-scanning direction, viewed from a direction of optical axes of the lenses; and the photosensitive member is located such that the surface of the photosensitive member is exposed to light at a position between an image surface of light that is emitted from a light emitting element located at a distance of a half of a pitch of the plurality of lenses from an optical axis of a first lens of the plurality of lenses and that passes through the first lens and an image surface of light that is emitted from a light emitting element located at a distance of the pitch of the plurality of lenses from an optical axis of a second lens of the plurality of lenses and that passes through the second lens.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

An image forming apparatus according to an embodiment of the present invention is hereinafter described.

Structure of Image Forming Apparatus

Figure 1:
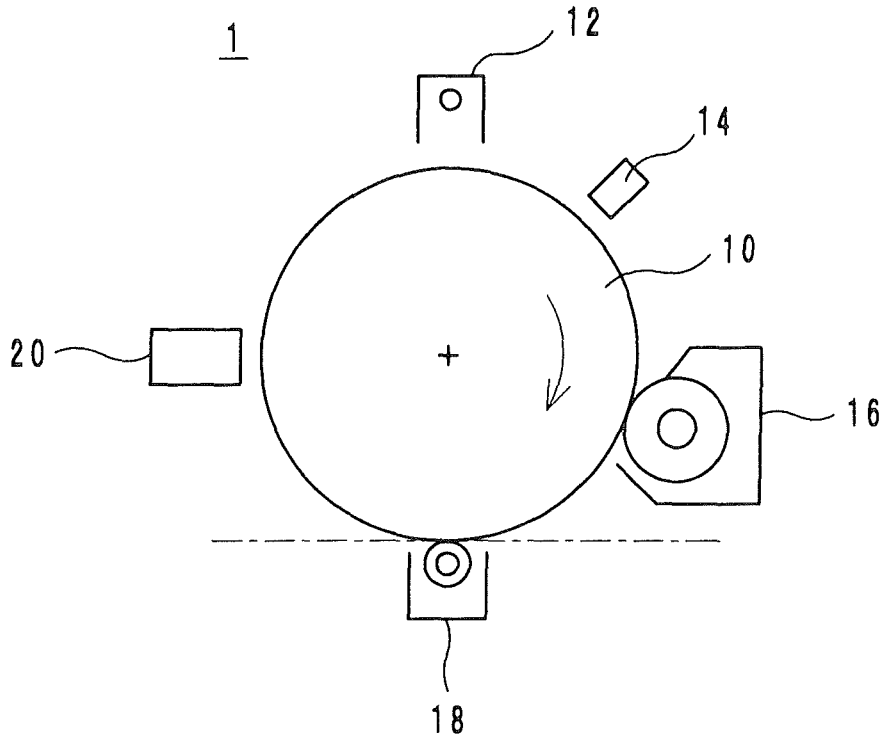
FIG. 1 is a schematic view around a photosensitive drum of an image forming apparatus according to an embodiment of the present invention.

First, referring to FIG. 1, an image forming apparatus 1 according to an embodiment of the present invention is described with reference to the accompanying drawings.

The image forming apparatus 1 is an electrophotographic color printer and is to form an image on a sheet in accordance with image data. The image forming apparatus 1 comprises a photosensitive drum 10, an electric charger 12, an exposure head 14, a developing device 16, a transfer roller 18 and a cleaner 20. The image forming apparatus 1 further comprises a feeding section, a fixing device and others. The feeding section, the fixing device and others are of conventional types, and the description thereof is omitted.

The photosensitive drum 10, which is cylindrical, is a member for bearing a toner image. The electric charger 12 is located to face the circumferential surface of the photosensitive drum 10 and charges the circumferential surface of the photosensitive drum 10. The exposure head 14 emits light to the photosensitive drum 10 so as to form an electrostatic latent image on the circumferential surface of the photosensitive drum 10. The developing device 16 stores toner therein and supplies toner to the circumferential surface of the photosensitive drum 10. Thereby, a toner image is formed in accordance with the electrostatic latent image. The transfer roller 18 transfers the toner image formed on the photosensitive drum 10 onto a sheet. The cleaner 20 removes residual toner from the circumferential surface of the photosensitive drum 10.

Figure 2:
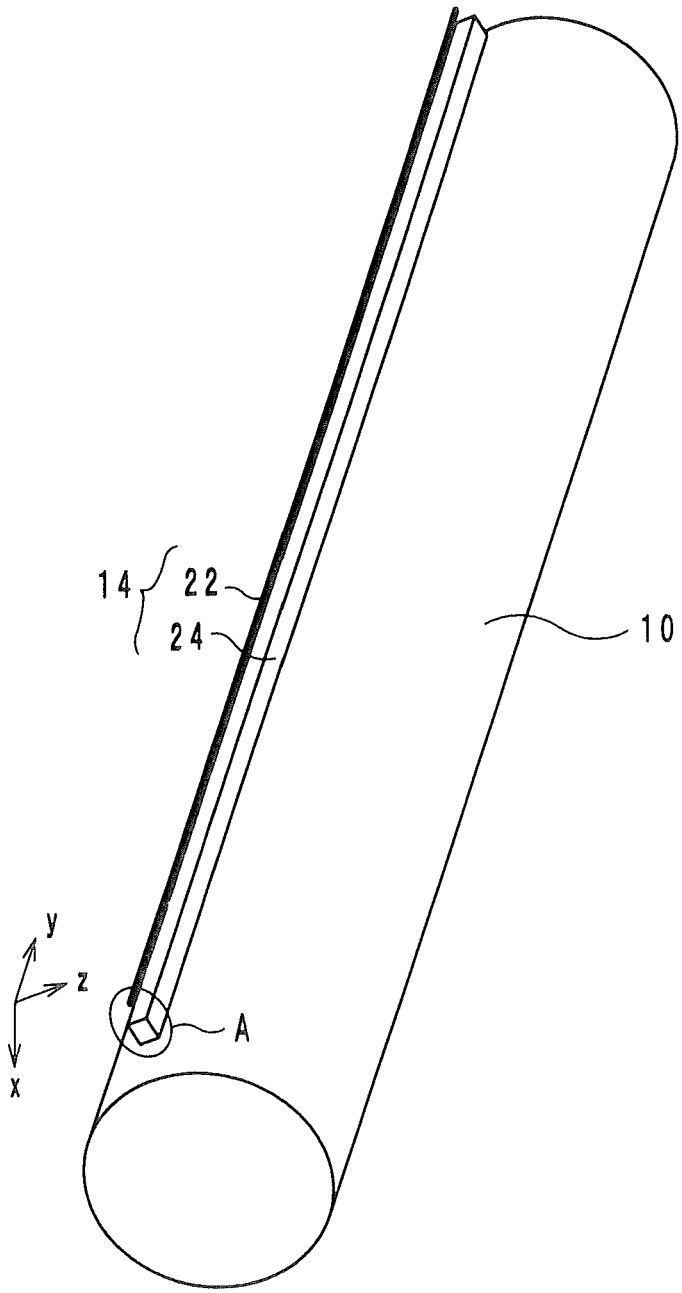
FIG. 2 is a perspective view of the photosensitive drum shown in FIG. 1 and an exposure head.
Figure 3:
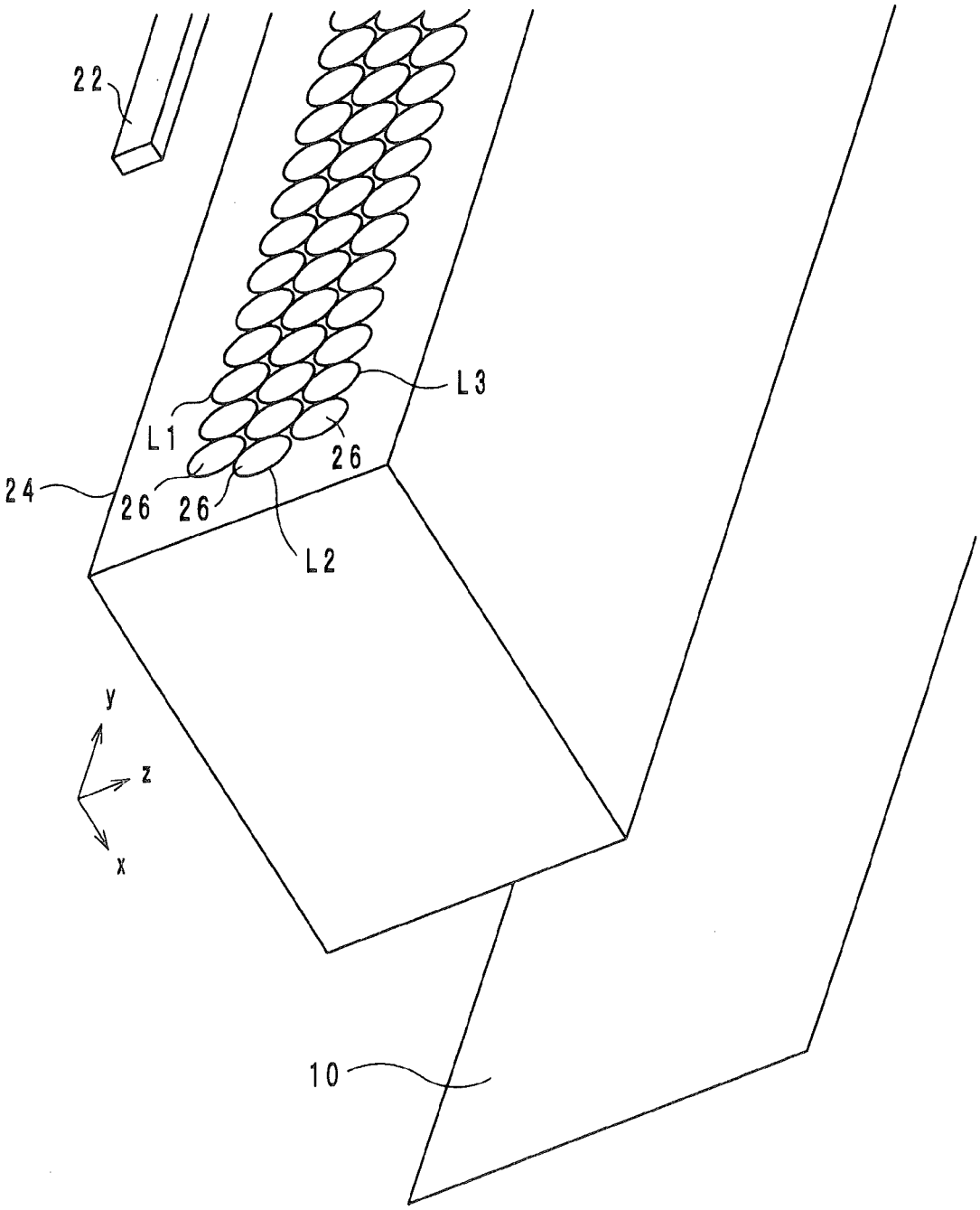
FIG. 3 is a magnified view of an area "A" shown in FIG. 2.
Figure 4:
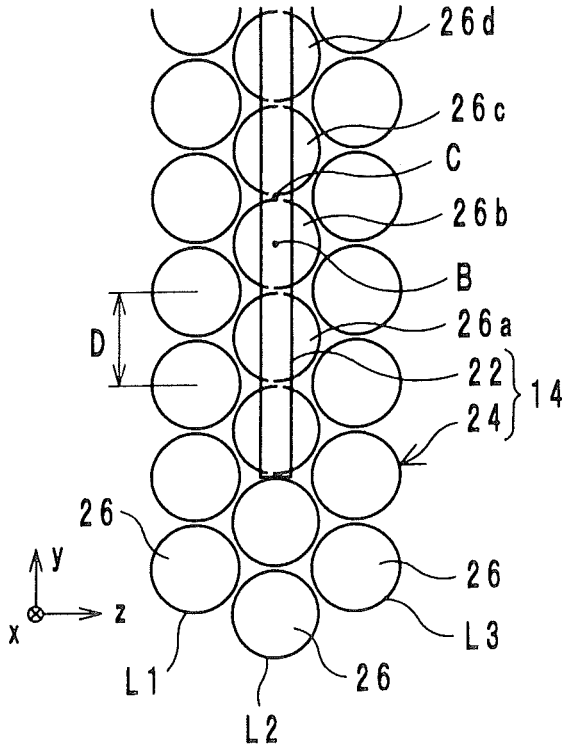
FIG. 4 is a plan view of a light source and a lens array, viewed from a direction of "x" axis.

Next, the exposure head 14 is described in more details, referring to FIGS. 2, 3 and 4.

The exposure head 14 comprises a light source 22 and a lens array 24. The light source 22 is composed of a plurality of LEDs (light emitting diodes) arranged in a line extending in a direction of "y" axis. The LEDs is aligned at a pitch of 0.021 mm.

As shown in FIG. 3, the lens array 24 is composed of a plurality of rod lenses 26 arranged in three lines (line L1 to line L3) extending in a direction of "y" axis, the rod lenses 26 of the neighboring lines being offset by one another. The lens array 24 is located between the light source 22 and the photosensitive drum 10 and images the light emitted from the light source 22 to form an erect equi-magnified image on the circumferential surface of the photosensitive drum 10. Each of the rod lenses 26 is a cylindrical lens that has a two-dimensional distribution of refractive index in its radical radial direction and that is 0.56 mm in diameter. The rod lenses 26 in each line are at a pitch of 0.6 mm (see "D" in FIG. 4). The optical axes of the rod lenses 26 are parallel to "x" axis.

As shown in FIG. 4, the light source 22 is located above the center (with respect to the direction of "z" axis) of the lens array 24. More specifically, in a plane viewed from the direction of "x" axis, the light source 22 is located on the optical axes of the rod lenses arranged in the middle line L2.

Figure 5A:
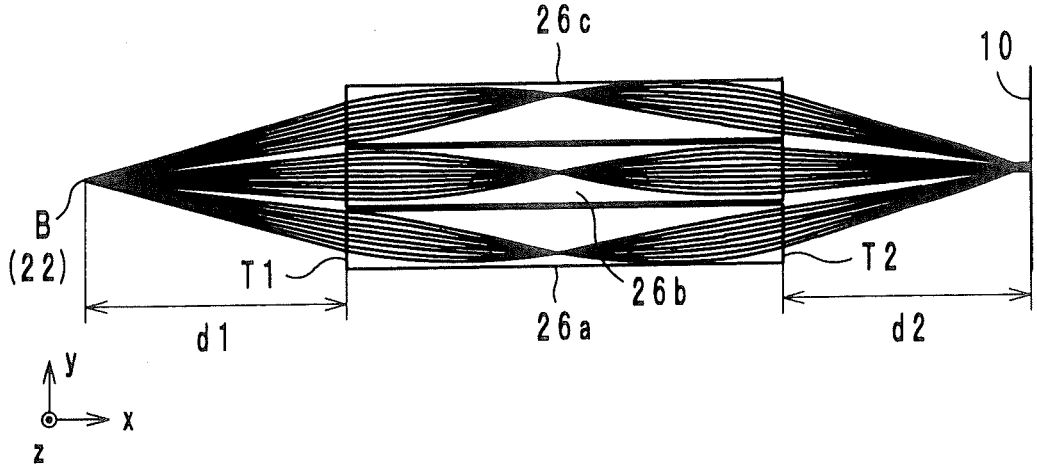
FIGS. 5*a* and 5*b* are illustrations of the light source and rod lenses showing the sectional structure in "xy" plane.
Figure 5B:
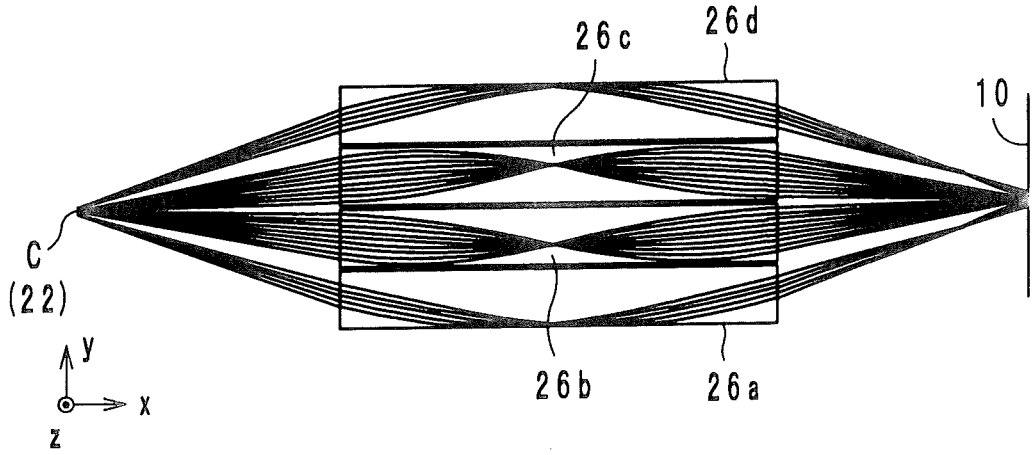

FIGS. 5*a* and 5*b* show the structure of the light source 22 and the rod lenses 26 in "xy" plane. The lens array 24 is to image the light from the light source 22 on the circumferential surface of the photosensitive drum 10 as an erect equi-magnified image. For this purpose, as shown by FIGS. 5*a* and 5*b*, the distance "d2" between the drum-side end surfaces T2 of the rod lenses 26 and the surface of the photosensitive drum 10 is substantially equal to the distance "d1" between the source-side end surfaces T1 of the rod lenses 26 and the light source 22.

The positional relationship between the surface of the photosensitive drum 10 and the rod lenses 26 is hereinafter described with reference to FIGS. 5*a* and 5*b*. The point "B" in FIG. 5*a* is a point on the light source 22, and in a plane viewed from the direction of "x" axis as shown by FIG. 4, the point "B" is on the optical axis of a rod lens 26*b*. The point "C" in FIG. 5*b* is a point on the light source 22, and in a plane viewed from the direction of "x" axis as shown by FIG. 4, the point "C" is on the midpoint between the optical axes of two rod lenses 26*b* and 26*c* adjacent to each other in the direction of "y" axis. FIG. 5*a* shows an optical path from the point "B" to the surface of the photosensitive drum 10 through the rod lens 26*b*, and the rod lenses 26*a* and 26*c* adjacent to the rod lens 26*b* in the direction of "y" axis. FIG. 5*b* shows an optical path from the point "C" to the surface of the photosensitive drum 10 through the rod lenses 26*b* and 26*c*, and the rod lenses 26*a* and 26*d* adjacent to the rod lenses 26*b* and 26*c*, respectively, in the direction of "y" axis.

In the image forming apparatus 1, light emitted from the light source 22 follows the optical path shown by FIG. 5*a*, the optical path shown by FIG. 5*b* or optical paths of a middle type between the optical path shown by FIG. 5*a* and the optical path shown by FIG. 5*b*. The peculiar optical paths shown by FIGS. 5*a* and 5*b* are hereinafter described, referring to specific examples.

When the angle of a light beam incident to a rod lens 26 to the optical axis of the rod lens 26 (which will be hereinafter referred to as angle of field) is greater than about 19 degrees, although the light enters into the effective area of the rod lens 26, the light is emergent from the rod lens 26 through a side surface thereof. In FIG. 5*a*, the light emitted from the point "B" enters into the rod lenses 26*a* and 26*c* at an angle of field of 13.2 degrees. In FIG. 5*b*, the light emitted from the point "C" enters into the rod lenses 26*b* and 26*c* at an angle of field of 6.7 degrees and enters into the rod lenses 26*a* and 26*d* at an angle of field of 19.4 degrees. As shown in FIGS. 5*a* and 5*b*, considering only the rod lens line L2, light emitted from an LED of the light source 22 passes through three or four rod lenses 26. In this case, considering all the three rod lens lines L1 to L3, light emitted from an LED of the light source 22 passes through seven to ten rod lenses 26. In the following description of FIG. 5*a*, three rod lenses 26*a* to 26*c* are mainly discussed, and in the following description of FIG. 5*b*, four rod lenses 26*a* to 26*d* are mainly discussed.

As shown by FIG. 5*a*, the image points of the light beams passing through the rod lenses 26*a* and 26*c* are in negative positions in the direction of "x" axis, compared with the image points of the light beam passing through the rod lens 26*b*. As shown by FIG. 5*b*, the image points of the light beams passing through the rod lenses 26*a* and 26*d* are in negative positions in the direction of "x" axis, compared with the image points of the light beams passing through the rod lenses 26*b* and 26*c*. Thus, depending on the angle of field of a light beam incident to the rod lens 26, the image point of the light beam varies. Accordingly, in FIG. 5*a*, the light that passed through the rod lenses 26*a* to 26*c* is not entirely imaged on the surface of the photosensitive drum 10. Likewise, in FIG. 5*b*, the light that passed through the rod lenses 26*a* to 26*d* is not entirely imaged on the surface of the photosensitive drum 10. Therefore, in order to form an electrostatic latent image of high contrast, the location of the photosensitive drum 10 relative to the rod lenses 26 is important. More specifically, the problem is which of the light beams passing through the rod lenses 26*a* to 26*d* is to be imaged precisely on the surface of the photosensitive drum 10.

In the image forming apparatus 1, the photosensitive drum 10 is located such that its circumferential surface is exposed to light at a position between an image surface of a light beam that is emitted from the LED at the point "C" (see FIG. 4) and that passes through the rod lenses 26*b* and 26*c* and an image surface of a light beam that is emitted from the LED at the point "B" (see FIG. 4) and that passes through the rod lenses 26*a* and 26*c*. The point "C" is at a distance of a half of the pitch "D" from both the optical axes of the rod lenses 26*b* and 26*c*, and the point "B" is at a distance of the pitch "D" from both the optical axes of the rod lenses 26*a* and 26*c*. That is, the photosensitive drum 10 is located such that light beams that enter into the rod lenses 26 at angles of field from 6.7 degrees to 13.2 degrees can be imaged on and around the surface of the photosensitive drum 10 satisfactorily.

In this image forming apparatus 1, the position of the surface of the photosensitive drum 10 does not agree with the image surface of a light beam that is emitted from the LED at the point "B" on the optical axis of the rod lens 26*b* and that passes through the rod lens 26*b*. In other words, the surface of the photosensitive drum 10 is positioned not based on rod lenses 26 located precisely opposite the LEDs but based on rod lenses 26 slightly displaced from the LEDs. While there is only one rod lens 26 that is precisely opposite an LED, there are two or more rod lenses 26 (two rod lenses 26 in the cases of FIGS. 5*a* and 5*b*) that are slightly displaced from an LED. Therefore, in the image forming apparatus 1, a larger quantity of light contributes to formation of an electrostatic latent image, and consequently, speed-up of the formation of an electrostatic latent image is possible.

In the image forming apparatus 1, also, the photosensitive drum 10 is located such that light beams that pass through a large number of rod lenses 26 can be imaged on and around the surface of the photosensitive drum 10. Accordingly, light emitted from the LEDs of the light source 22 can be imaged on the surface of the photosensitive drum 10 satisfactorily, and consequently, the contrast of an electrostatic latent image is improved.

First Embodiment

An image forming apparatus 1 of the above-described structure according to a first embodiment is described with reference to the accompanying drawings. In the image forming apparatus 1 according to the first embodiment, the LEDs are arranged at a pitch of 0.021 mm. The pitch "D" of the rod lenses 26 is 0.6 mm, and each of the rod lenses 26 is 0.56 mm in diameter.

First Simulation

In the image forming apparatus 1 according to the first embodiment having the specifications, as a first simulation, the amount of defocus from the surface of the photosensitive drum 10 was simulated by using a computer with the angle of field of a light beam incident to a rod lens 26 varied between 0 degrees, 6.7 degrees and 13.2 degrees. A light beam at an angle of field of 0 degrees means, in the case of FIG. 5*a*, the light beam that is emitted from the LED at the point "B" and that enters into the rod lens 26*b*. A light beam at an angle of field of 6.7 degrees means, in the case of FIG. 5*b*, the light beam that is emitted from the LED at the point "C" and that enters into the rod lens 26*b* or 26*c*. A light beam at an angle of field of 13.2 degrees means, in the case of FIG. 5*a*, the light beam that is emitted from the LED at the point "B" and that enters into the rod lens 26*a* or 26*c*.

Figure 6A:
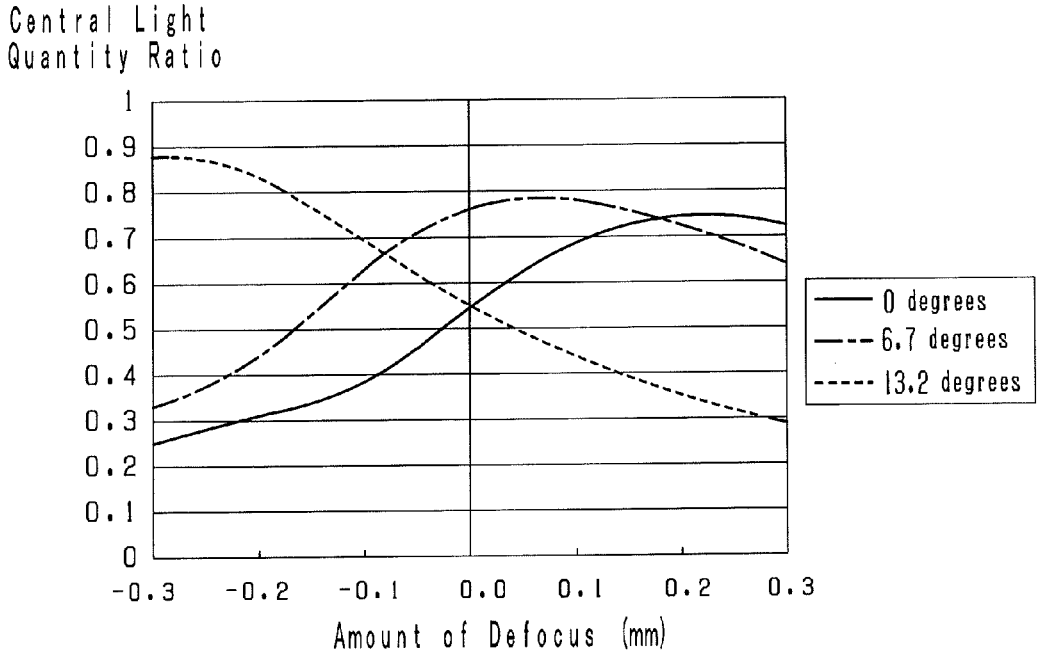
FIGS. 6*a* and 6*b* are graphs showing the relationship between the defocus and the central light quantity ratio.
Figure 6B:
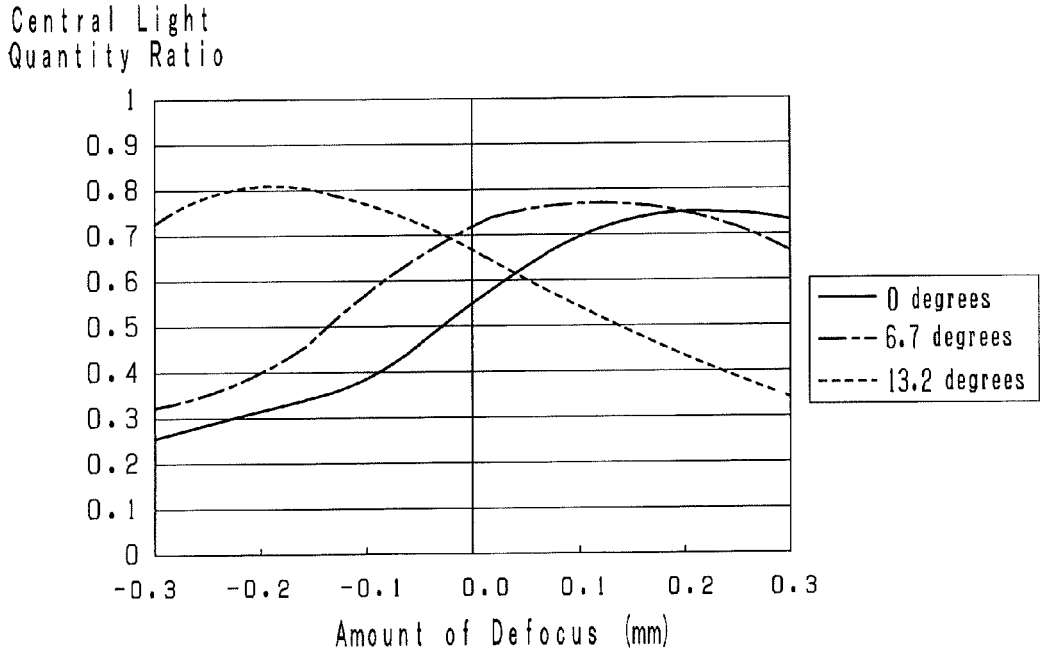

FIGS. 6*a* and 6*b* are graphs showing the results of the first simulation. In the graphs, the vertical axis indicates the central light quantity ratio, and the horizontal axis indicates the amount of defocus. The central light quantity ratio is the ratio of the quantity of light that was emitted from an LED and was imaged within a width of 0.021 mm (corresponding to a dot in a case of 1200 dpi) on the surface of the photosensitive drum 10 to the quantity of light that was emitted from the LED and that reached the surface of the photosensitive drum 10 through one or more rod lenses 26. In the first simulation, with regard to light that was emitted from one LED and that passed through one rod lens 26, the central light quantity ratio was simulated. It is in an aberration-free optical system that the central light quantity ratio is one. The amount of defocus is an amount of displacement of the image point from the surface of the photosensitive drum 10. Here, the distance between the rod lens 26 and the surface of the photosensitive drum is 2.55 mm. The graph of FIG. 6*a* shows a distribution of the central light quantity ratio in the radial direction of a rod lens 26, and this distribution was obtained by adding light quantities in a direction perpendicular to the plane including the principal ray and the optical axis (perpendicular to the meridional plane). The graph of FIG. 6*b* shows a distribution of the central light quantity ratio in the circumferential direction of a rod lens 26, and this distribution was obtained by adding light quantities in a direction parallel to the plane including the principal ray and the optical axis (parallel to meridional plane). As is apparent from FIGS. 6*a* and 6*b*, the larger the angle of field is, the further in the negative direction the amount of defocus is.

Second Simulation

Figure 7:
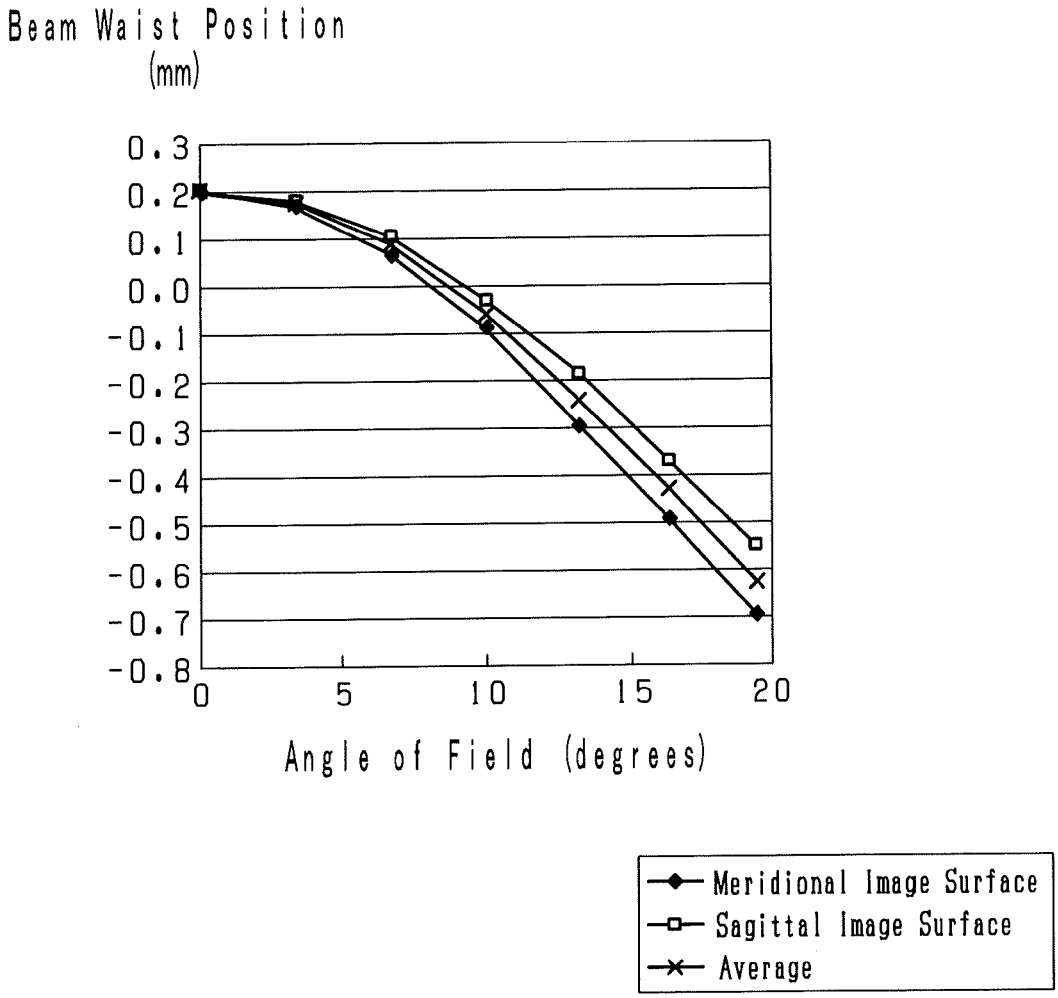
FIG. 7 is a graph showing the field curvature of a rod lens in an image forming apparatus according to a first embodiment.

Next, as a second simulation, the curvature of field of a rod lens 26 was simulated based on FIGS. 6*a* and 6*b*. FIG. 7 shows the result of the second simulation. The vertical axis indicates the beam waist position, and the horizontal axis indicates the angle of field. The beam waist position in FIG. 7 corresponds to the amount of defocus shown in FIGS. 6*a* and 6*b*. In the second simulation, the apex of each curve in FIG. 6*a* was plotted as a beam waist position on the meridional image surface, and the apex of each curve in FIG. 6*b* was plotted as a beam waist position on the sagittal image surface. Although not shown in the drawings, the cases with the angle of field at 0 degrees, 6.7 degrees and 13.2 degrees but also other cases with the angle of field at other degrees were simulated, and graphs similar to FIGS. 6*a* and 6*b* were obtained. Then, the results shown by these graphs were also plotted in FIG. 7. In this specification, an image surface does not mean a paraxial image surface but means a surface formed by connecting beam waists.

As is apparent from FIG. 7, as the angle of field of a light beam incident to a rod lens 26 becomes larger, the image surface moves closer to the light source 22 (moves further in the negative direction along the "x" axis). Accordingly, as shown by FIGS. 5*a* and 5*b*, light emitted from even a single LED is imaged on different points in the direction of "x" axis because the light passes through different rod lenses 26. Further, each of the LEDs has a peculiar relationship between the direction of the sagittal/meridional surface and the direction of the main-scanning/sub-scanning direction. Accordingly, combining light beams that passed through different rod lenses 26 with each other means combining light beams that are different from each other in the direction of the sagittal/meridional surface. Therefore, in considering the image surface, it is better to treat the sagittal image surface and the meridional image surface in average than to treat them separately.

Third Simulation

Figure 8A:
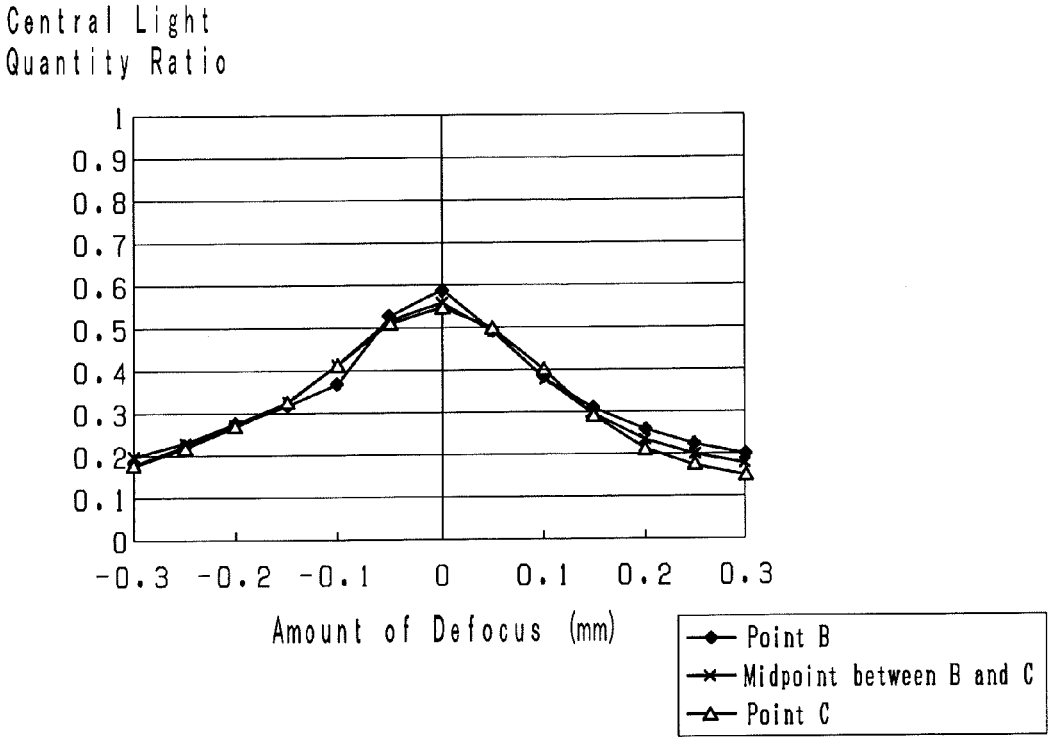
FIGS. 8*a* and 8*b* are graphs showing the relationship between the defocus and the central light quantity ratio.
Figure 8B:
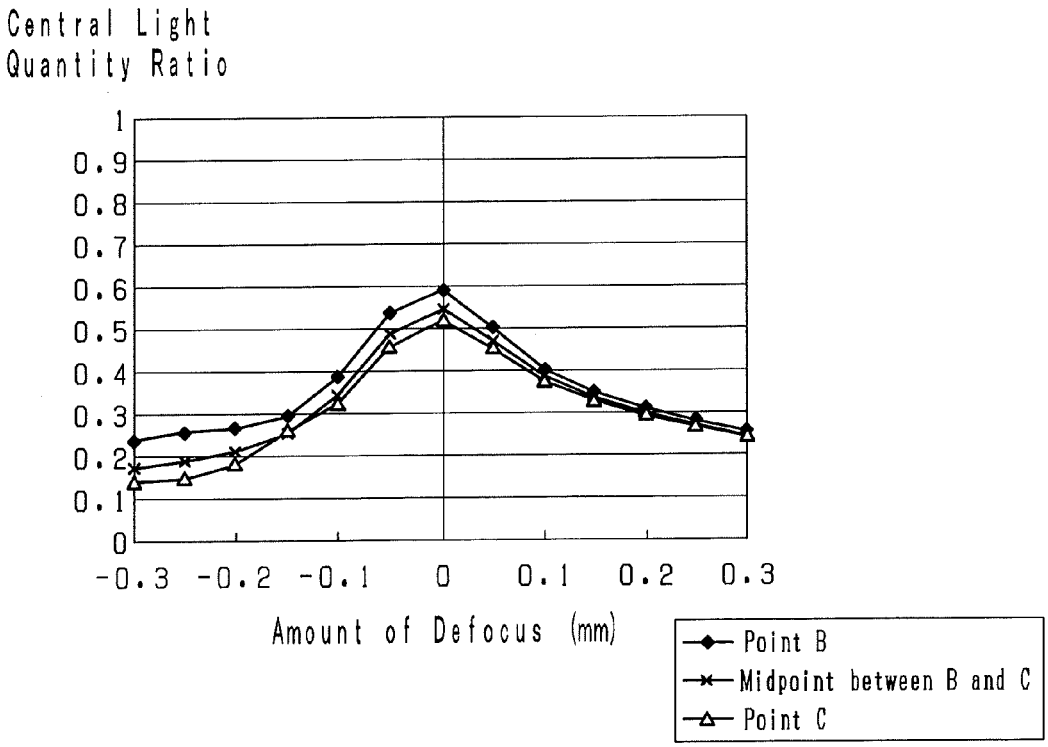

As a third simulation, with regard to the entire light that was emitted from one LED and that reached the surface of the photosensitive drum 10 through a plurality of rod lenses 26, the central light quantity ratio was simulated. FIGS. 8*a* and 8*b* show the results of the third simulation and are graphs showing the relationship between the central light quantity ratio and the amount of defocus. In each graph of FIGS. 8*a* and 8*b*, the vertical axis indicates the central light quantity ratio, and the horizontal axis of the amount of defocus. The light quantity ratio shown in FIG. 8*a* is that in the "z" direction, and the light quantity ratio shown in FIG. 8*b* is that in the "y" direction. In the third simulation, with respect to light emitted from the LED at the point "B", with respect to light emitted from the LED at the point "C" and with respect to light emitted from the LED at the midpoint between the point "B" and the point "C", the relationship between the amount of defocus and the central light quantity ratio was calculated.

As is apparent from FIGS. 8*a* and 8*b*, the central light quantity ratio of the light emitted from the LED at the midpoint between the point "B" and the point "C" has a mid value between that of the light emitted from the LED at the point "B" and that of the light emitted from the LED at the point "C". Therefore, it is understood that light emitted from every LED has a central light quantity ratio between that of the light emitted from the LED at the point "B" and that of the light emitted from the LED at the point "C". Accordingly, by locating the photosensitive drum 10, the light source 22 and the lens array 24 such that both the light emitted from the LED at the point "B" and the light emitted from the LED at the point "C" can be imaged on the surface of the photosensitive drum 10 satisfactorily, the light emitted from every LED will be imaged on the surface of the photosensitive drum 10 satisfactorily.

The central light quantity ratio of light that passed through a plurality of rod lenses 26 (as shown by FIGS. 8*a* and 8*b*) is lower than that of light that passed through a single rod lens 26 (as shown by FIGS. 6*a* and 6*b*). Further, the central light quantity ratio of light that passed through a plurality of rod lenses 26 changes steeply with changes in the amount of defocus, compared with that of light that passed through a single rod lens 26. This means that the image points of light beams that passed through a plurality of rod lenses 26 vary not only in the direction of "x" axis but also on the "yz" plane.

Fourth Simulation

Figure 9A:
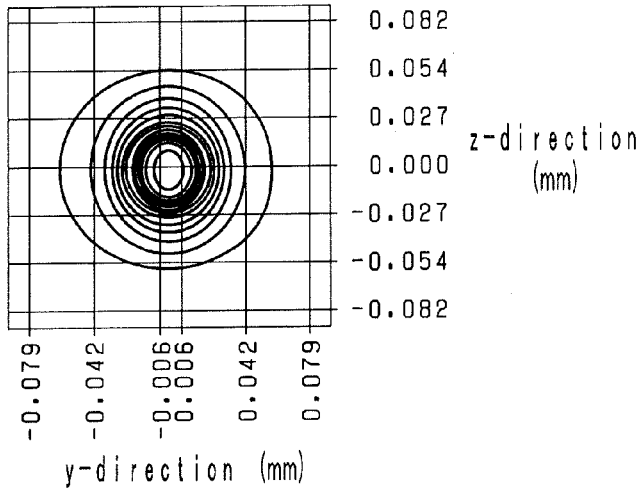
FIGS. 9*a*, 9*b* and 9*c* are illustrations showing the shapes of light beams projected on the surface of the photosensitive drum after passing through the rod lenses.
Figure 9B:
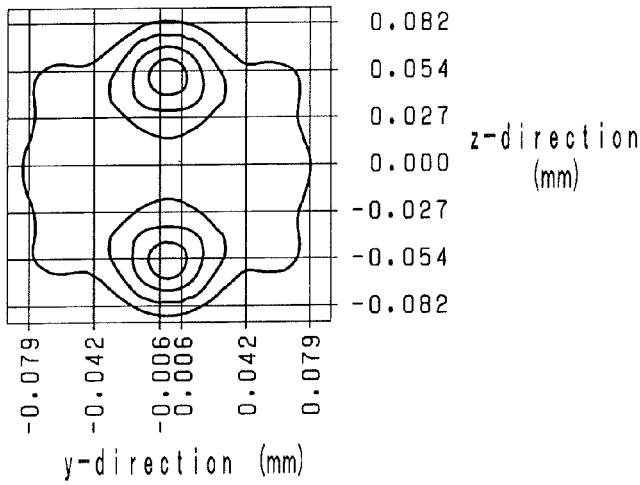
Figure 9C:
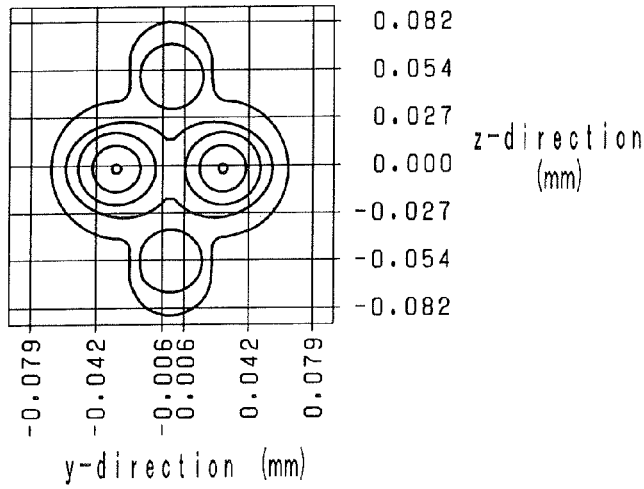

Next, as a fourth simulation, the beam shape on the surface of the photosensitive drum 10 of light that passed through a plurality of rod lenses 26 was simulated. FIGS. 9*a*-9*c* show the results of the fourth simulation. FIG. 9*a* shows the beam shape in a case wherein the amount of defocus was 0 mm. FIG. 9*b* shows the beam shape in a case wherein the amount of defocus was +0.15 mm. FIG. 9*c* shows the beam shape in a case wherein the amount of defocus was −0.15 mm.

As is apparent from FIG. 9*a*, in the case wherein the amount of defocus is 0 mm, light beams that passed through a plurality of rod lenses 26 are projected on the surface of the photosensitive drum 10 substantially at a point. However, as is apparent from FIGS. 6*a* and 6*b*, the amount of defocus differs in accordance with the angle of field at which the light beam enters into the rod lens 26. Therefore, when light beams that passed through a plurality of rod lenses 26 are combined with one another on the surface of the photosensitive drum 10, some beams are not imaged thereon.

In the case wherein the amount of defocus is ±0.15 mm, light beams that passed through a plurality of rod lenses 26 are projected on the surface of the photosensitive drum 10 at different points. That is, light beams that passed through a plurality of rod lenses 26 are projected on the "yz" plane at different points. As is apparent from FIGS. 9*b* and 9*c*, light beams that passed through different rod lenses 26 are projected at points corresponding to the positions of the respective rod lenses 26. Also, the convergence of a light beam depends on the angle of field at which the light beam enters into the rod lens 26.

Fifth Simulation

Figure 10A:
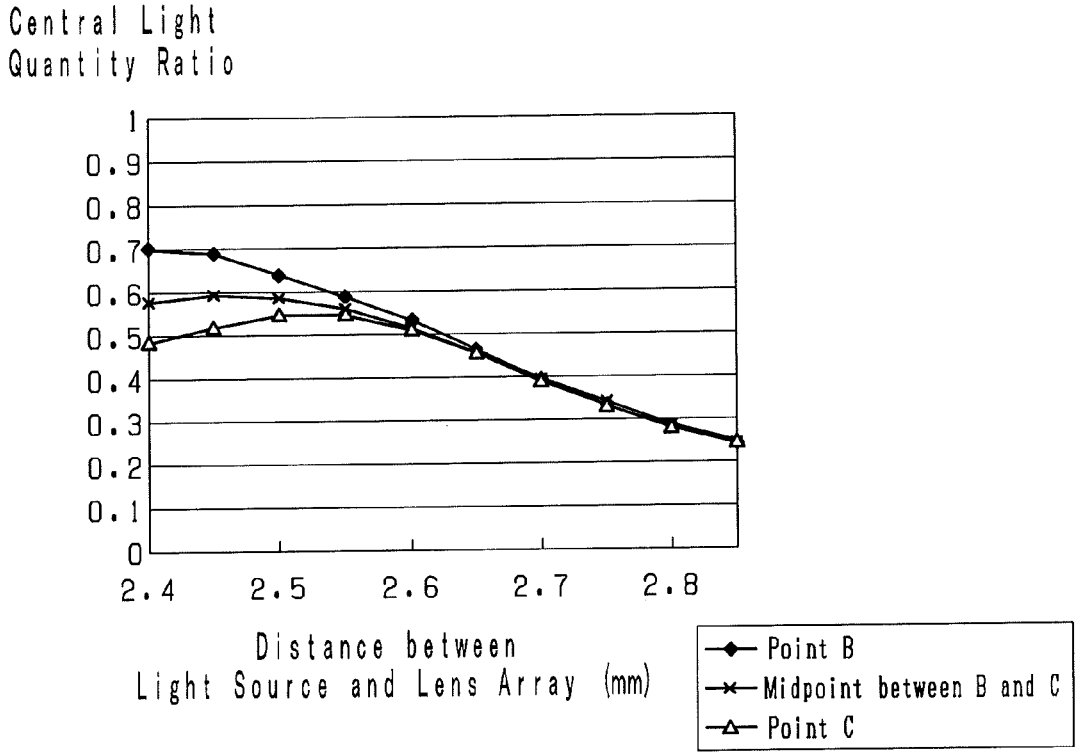
FIGS. 10*a* and 10*b* are graphs showing the relationship between the distance between the light source and the lens array and the central light quantity ratio.
Figure 10B:
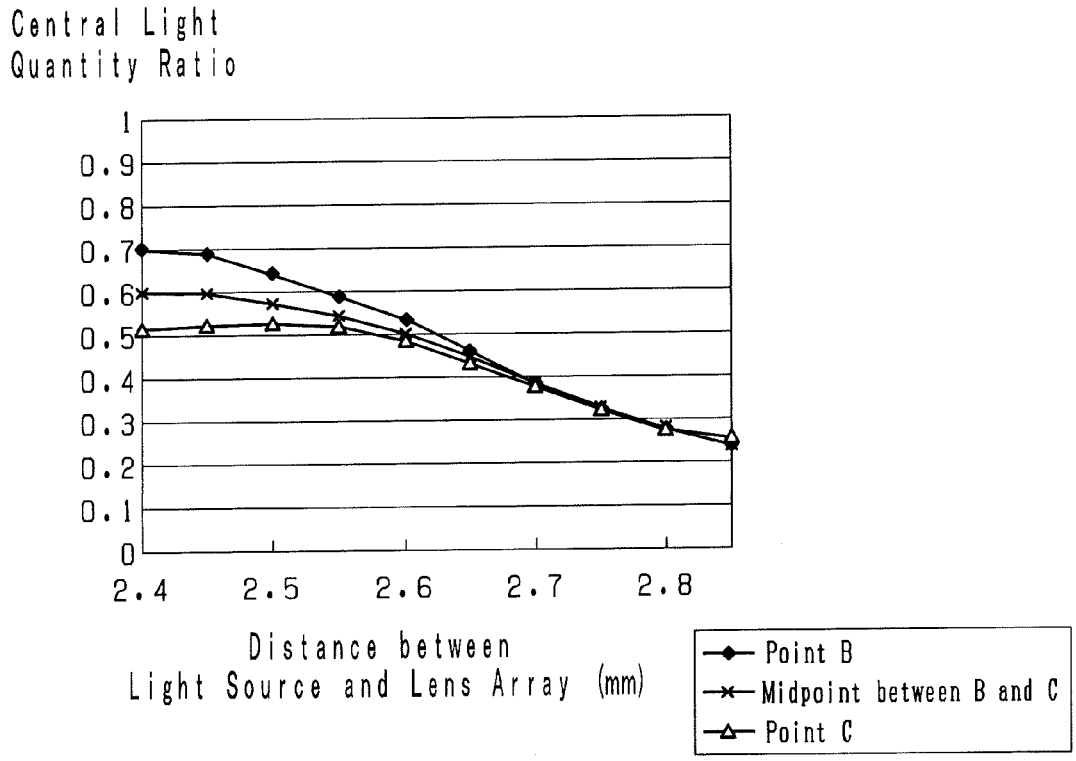

As a fifth simulation, variation in the central light quantity ratio with changes in the distance between the light source 22 and the lens array 24 (distance "d1" in FIGS. 5*a* and 5*b*) was simulated. In the first to the fourth simulations, while the distance between the light source 22 and the lens array 24 was fixed, the position of the surface of the photosensitive drum 10 was changed. In the fifth simulation, however, the distance between the light source 22 and the lens array 24 and also the distance between the lens array 24 and the photosensitive drum 10 (distance "d2" in FIGS. 5*a* and 5*b*) were changed by the same amount so that light that passes through the lens array 24 could be formed into an erect equi-magnified image on the photosensitive drum 10. FIGS. 10*a* and 10*b* are graphs showing the results of the fifth simulation. In the graphs, the vertical axis indicates the central light quantity ratio, and the horizontal axis indicates the distance between the light source 22 and the lens array 24. FIG. 10*a* shows the central light quantity ratio in the direction of "z" axis, and FIG. 10*b* shows the central light quantity ratio in the direction of "y".

In the first to the fourth simulations, the distance between the light source 22 and the lens array 24 was fixed at 2.55 mm. In the fifth simulation, the distance between the light source 22 and the lens array 24 was increased and decreased from 2.55 mm. As is apparent from FIG. 10*a*, when the distance between the light source 22 and the lens array 24 becomes smaller than 2.55 mm, the central light quantity ratio of light that was emitted from the LED at the point "B" in FIG. 5*b* and that passed through the rod lenses 26*a* to 26*c* increases, and the central light quantity ratio of light that was emitted from the LED at the point "C" in FIG. 5*b* and that passed through the rod lenses 26*a* to 26*d* decreases. When the distance between the light source and the lens array 24 becomes larger than 2.55 mm, both the central light quantity ratio of light that was emitted from the LED at the point "B" in FIG. 5*b* and that passed through the rod lenses 26*a* to 26*c* and the central light quantity ratio of light that was emitted from the LED at the point "C" in FIG. 5*b* and that passed through the rod lenses 26*a* to 26*d* decrease. Therefore, it is preferred that the distance between the light source 22 and the lens array 24 is set to 2.55 mm.

Further, as seen in the graph of FIG. 7, which shows the results of the second simulation, the beam waist position of a light beam that entered into a rod lens 26 at an angle of field of 6.7 degrees is +0.088 mm, and the beam waist position of a light beam that entered into a rod lens 26 at an angle of field of 13.2 degrees is −0.24 mm. In the second simulation, while the distance between the light source 22 and the lens array 24 is fixed at 2.55 mm, the position of the surface of the photosensitive drum 10 was changed from the reference point wherein the distance between the photosensitive drum 10 and the rod lenses 26 is 2.55 mm. In the fifth simulation, however, the distance between the light source 22 and the lens array 24 and the distance between the lens array 24 and the photosensitive drum 10 were changed by the same amount so that light that passes through the lens array 24 could be formed into an erect equi-magnified image on the photosensitive drum 10. Accordingly, the amount of a change in the distance between the light source 22 and the lens array 24 in the fifth simulation corresponds to double the amount of defocus in the second simulation. Therefore, in order to image a light beam that entered into a rod lens 26 at an angle of field of 6.7 degrees on the surface of the photosensitive drum 10, both the distance between the light source 22 and the lens array 24 and the distance between the lens array 24 and the surface of the photosensitive drum 10 shall be decreased by 0.44 mm, respectively. Likewise, in order to image a light beam that entered into a rod lens 26 at an angle of field of 13.2 degrees on the surface of the photosensitive drum 10, both the distance between the light source 22 and the lens array 24 and the distance between the lens array 24 and the surface of the photosensitive drum 10 shall be increased by 0.12 mm, respectively. Thus, in the image forming apparatus 1 according to the first embodiment, the distance between the light source 22 and the lens array 24 and the distance between the lens array 24 and the surface of the photosensitive drum 10 shall be set within a range from 2.51 mm to 2.67 mm, respectively. Thereby, in the image forming apparatus 1, it is possible to form an electrostatic latent image of high quality at a high speed.

Second Embodiment

An image forming apparatus 1 according to a second embodiment is hereinafter described with reference to the accompanying drawings. In the image forming apparatus 1 according to the second embodiment, the LEDs are arranged at a pitch of 0.021 mm, and the rod lenses 26 are arranged at a pitch D of 0.5 mm. The rod lenses 26 are 0.46 mm in diameter. The rod lenses 26 in the second embodiment have a smaller diameter than those in the first embodiment, and accordingly, each rod lens 26 can transmit light that enters therein at an angle of field within about 16 degrees to the photosensitive drum 10.

Figure 11A:
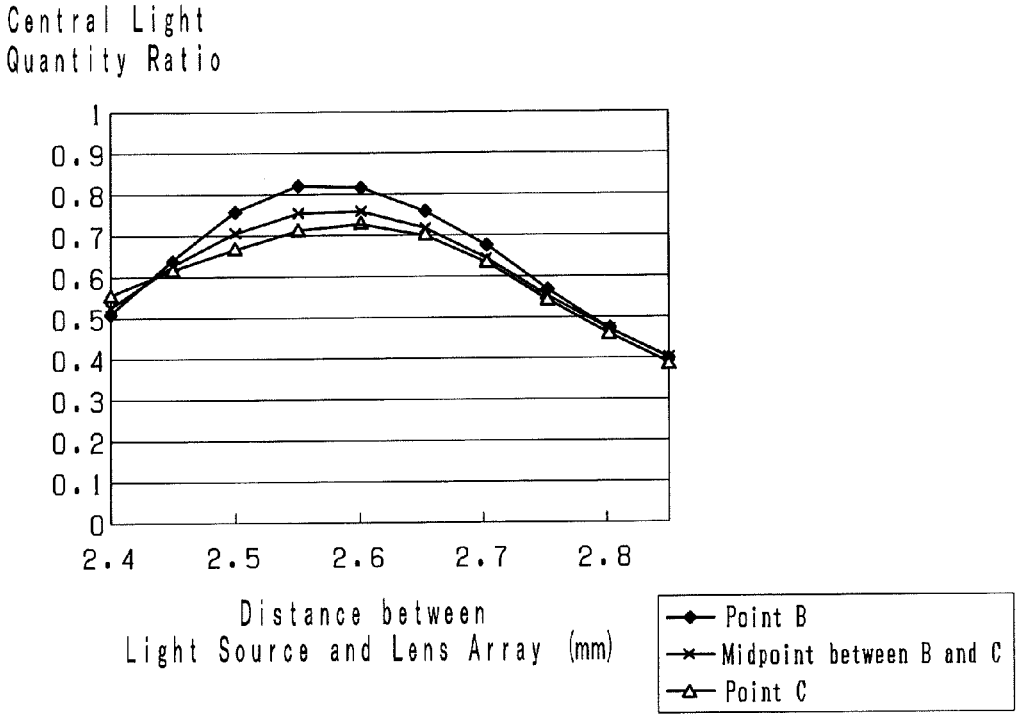
FIGS. 11*a* and 11*b* are graphs showing the relationship between the distance between the light source and the lens array and the central light quantity ratio.
Figure 11B:
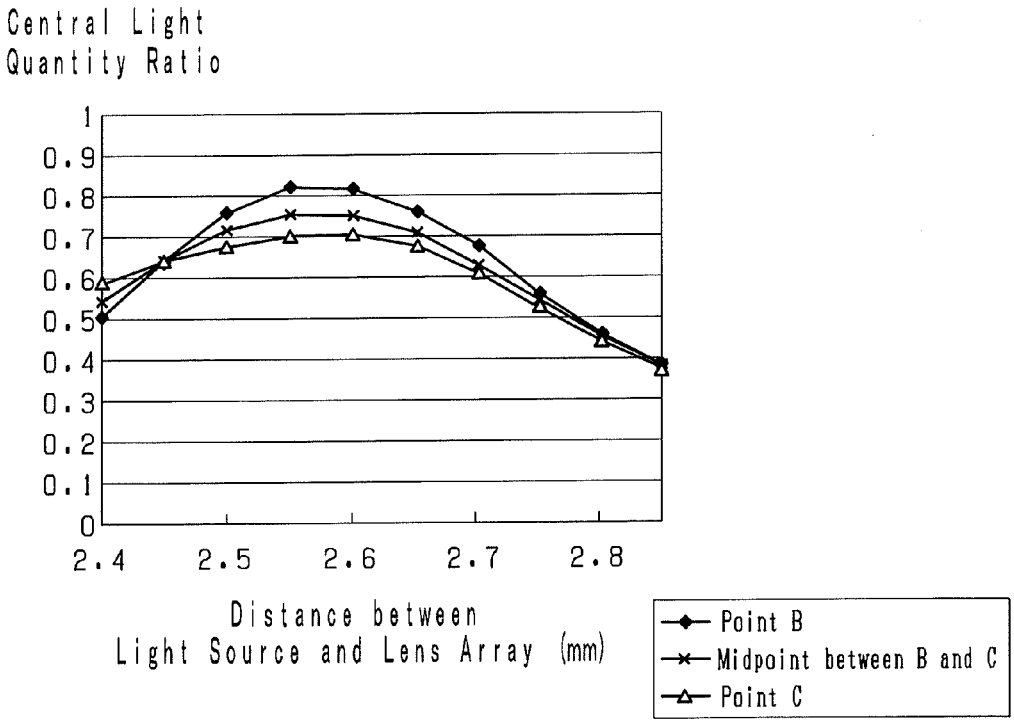

In the image forming apparatus 1 according to the second embodiment having the specifications, the above-described fifth simulation was conducted. FIGS. 11*a* and 11*b* are graphs showing the results of the fifth simulation. In the graphs, the vertical axis indicates the central light quantity ratio, and the horizontal axis indicates the distance between the light source 22 and the lens array 24. FIG. 11*a* shows the central light quantity ratio in the direction of "z" axis, and FIG. 11*b* shows the central light quantity ratio in the direction of "y" axis. As is apparent from FIGS. 11*a* and 11*b*, in the image forming apparatus 1 according to the second embodiment, it is preferred that the distance between the light source 22 and the lens array 24 and the distance between the lens array 24 and the surface of the photosensitive drum 10 are set to 2.6 mm.

Figure 12:
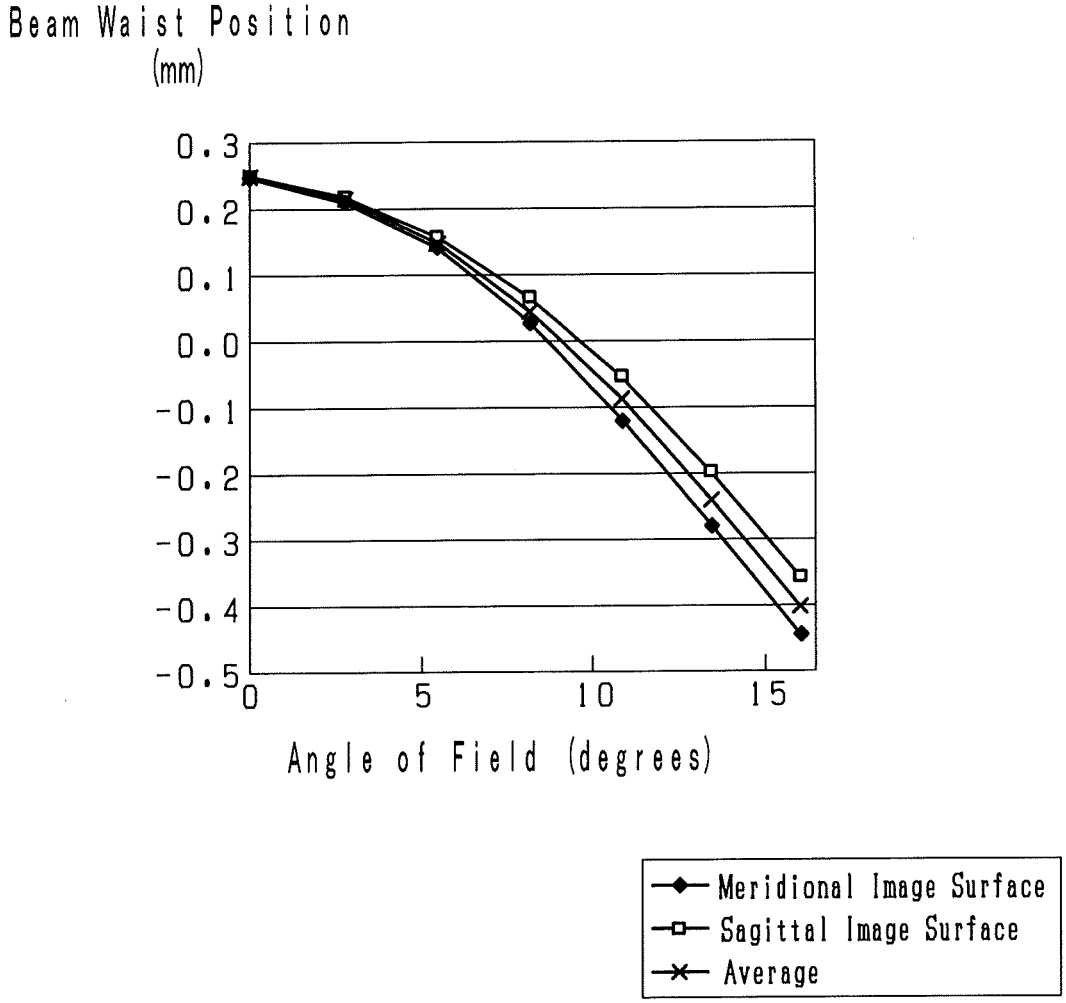
FIG. 12 is a graph showing the field curvature of a rod lens in an image forming apparatus according to a second embodiment.

In the image forming apparatus 1 according to the second embodiment, further, the above-described second simulation was conducted. FIG. 12 is a graph showing the second simulation. In the graph, the vertical axis indicates the beam waist position, and the horizontal axis indicates the angle of field.

In the image forming apparatus 1 according to the second embodiment, in a case as shown by FIG. 5*a*, light emitted from the LED at the point "B" enters into the rod lenses 26*a* and 26*b* at an angle of field of 10.9 degrees. In a case as shown by FIG. 5*b*, light emitted from the LED at the point "C" enters into the rod lenses 26*b* and 26*c* at an angle of field of 5.5 degrees. As shown in FIG. 12, the beam waist position of light that entered into a rod lens 26 at an angle of field of 5.5 degrees is +0.15 mm, and the beam waist position of light that entered into a rod lens 26 at an angle of field of 10.9 degrees is −0.088 mm. Accordingly, in the image forming apparatus 1 according to the second embodiment, the distance between the light source 22 and the lens array 24 and the distance between the lens array 24 and the surface of the photosensitive drum 10 shall be set within a range from 2.53 mm to 2.64 mm. Thereby, in the image forming apparatus 1, it is possible to form an electrostatic latent image of high quality at a high speed.

Compared with the image forming apparatus 1 according to the first embodiment, in the image forming apparatus 1 according to the second embodiment, the rod lenses 26 are smaller in diameter, and accordingly, while the quantity of light reaching the photosensitive drum 10 is smaller, the contrast is better.

Third Embodiment

An image forming apparatus according to a third embodiment is hereinafter described with reference to the accompanying drawings. In the image forming apparatus according to the third embodiment, the LEDs are arranged at a pitch of 0.021 mm, and the rod lenses 26 are arranged at a pitch D of 0.4 mm. The rod lenses 26 are 0.37 mm in diameter. The rod lenses 26 in the third embodiment have a smaller diameter than those in the second embodiment, and accordingly, each rod lens 26 can transmit light that enters therein at an angle of field within about 13 degrees to the photosensitive drum 10.

Figure 13A:
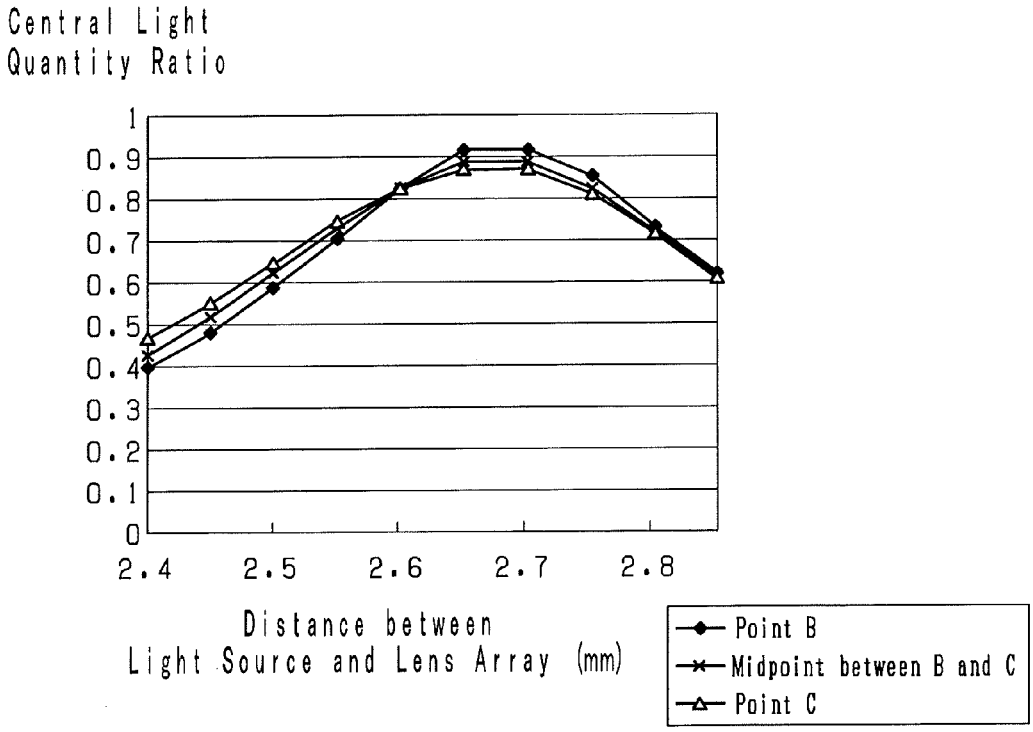
FIGS. 13*a* and 13*b* are graphs showing the relationship between the distance between the light source and the lens array and the central light quantity ratio.
Figure 13B:
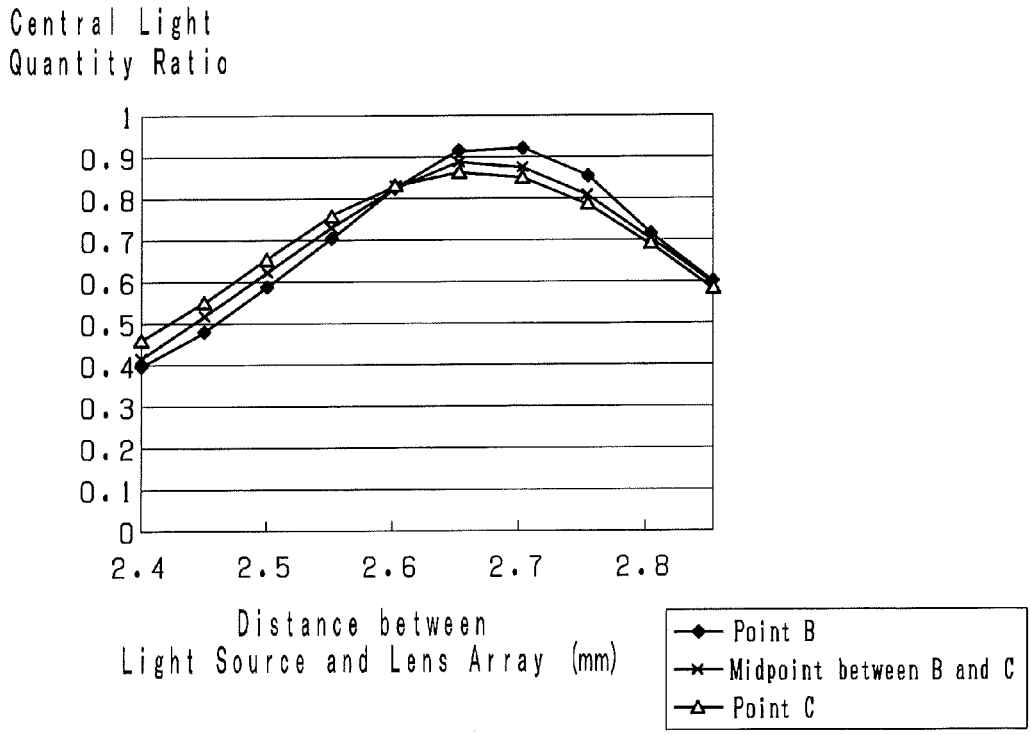

In the image forming apparatus 1 according to the third embodiment having the specifications, the above-described fifth simulation was conducted. FIGS. 13*a* and 13*b* are graphs showing the results of the fifth simulation. In the graphs, the vertical axis indicates the central light quantity ratio, and the horizontal axis indicates the distance between the light source 22 and the lens array 24. FIG. 13*a* shows the central light quantity ratio in the direction of "z" axis, and FIG. 13*b* shows the central light quantity ratio in the direction of "y" axis. As is apparent from FIGS. 13*a* and 13*b*, in the image forming apparatus 1 according to the third embodiment, it is preferred that the distance between the light source 22 and the lens array 24 and the distance between the lens array 24 and the surface of the photosensitive drum 10 are set to 2.7 mm.

Figure 14:
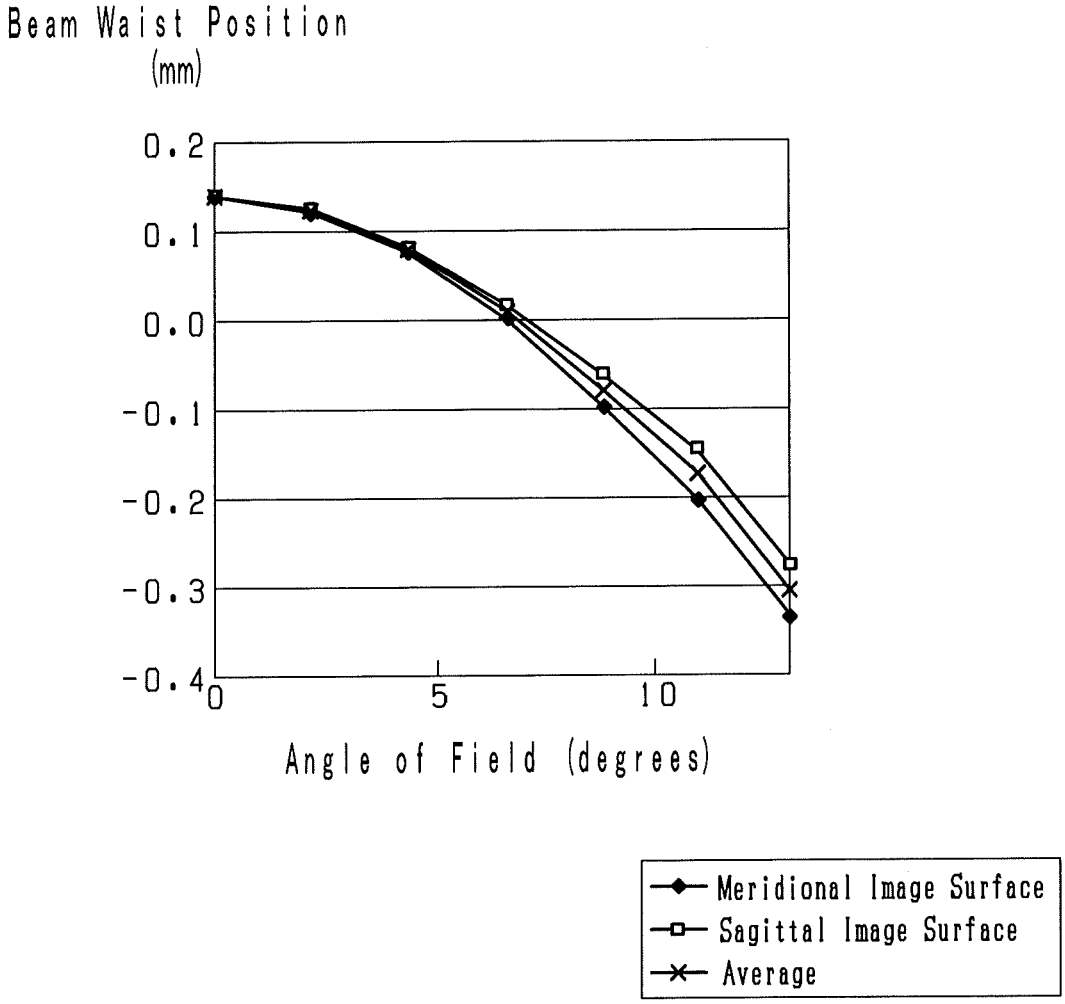
FIG. 14 is a graph showing the field curvature of a rod lens in an image forming apparatus according to a third embodiment.

In the image forming apparatus 1 according to the third embodiment, further, the above-described second simulation was conducted. FIG. 14 is a graph showing the second simulation. In the graph, the vertical axis indicates the beam waist position, and the horizontal axis indicates the angle of field.

In the image forming apparatus 1 according to the third embodiment, in a case as shown by FIG. 5*a*, light emitted from the LED at the point "B" enters into the rod lenses 26*a* and 26*b* at an angle of field of 8.7 degrees. In a case as shown by FIG. 5*b*, light emitted from the LED at the point "C" enters into the rod lenses 26*b* and 26*c* at an angle of field of 4.4 degrees. As shown in FIG. 14, the beam waist position of light that entered into a rod lens 26 at an angle of field of 4.4 degrees is +0.078 mm, and the beam waist position of light that entered into a rod lens 26 at an angle of field of 8.7 degrees is −0.083 mm. Accordingly, in the image forming apparatus according to the third embodiment, the distance between the light source 22 and the lens array 24 and the distance between the lens array 24 and the surface of the photosensitive drum 10 shall be set within a range from 2.66 mm to 2.74 mm. Thereby, in the image forming apparatus 1, it is possible to form an electrostatic latent image of high quality at a high speed.

Compared with the image forming apparatuses 1 according to the first embodiment and the second embodiment, in the image forming apparatus 1 according to the third embodiment, the rod lenses 26 are smaller in diameter, and accordingly, while the quantity of light reaching the photosensitive drum 10 is smaller, the contrast is better.

Although the present invention has been described in connection with the preferred embodiments above, it is to be noted that various changes and modifications are possible to those who are skilled in the art. Such changes and modifications are to be understood as being within the scope of the invention.

What is claimed is:

1. An image forming apparatus comprising:

a photosensitive member;

a light source comprising a plurality of light emitting elements arranged in a line extending in a main-scanning direction; and a lens array comprising a plurality of lenses that are arranged in three lines extending in the main-scanning direction such that the lenses of the neighboring lines are offset by one another, the lens array being for imaging light emitted from the light source to form an erect equi-magnified image on a surface of the photosensitive member, wherein the light source is arranged above a center of the lens array in the sub-scanning direction, viewed from a direction of optical axes of the lenses, and wherein the light source is located on a longitudinal center line of a middle line of the plurality of lenses; and wherein the photosensitive member is located such that the surface of the photosensitive member is exposed to light from a first light emitting element located at a distance of a half of a pitch of the plurality of lenses from an optical axis of a first lens of the plurality of lenses and that passes through the first lens and from a second light emitting element located at a distance of the pitch of the plurality of lenses from an optical axis of a second lens of the plurality of lenses and that passes through the second lens.

2. An image forming apparatus according to claim 1, wherein each of the plurality of lenses has a first end and a second end, the first ends being closer to the photosensitive member and the second ends being closer to the light emitting elements, and wherein a distance between the first ends of the plurality of lenses and the surface of the photosensitive member is equal to a distance between the second ends of the plurality of lenses and the light emitting elements.

3. An image forming apparatus according to claim 2, wherein the distance between the first ends of the plurality of lenses and the surface of the photosensitive member and the second ends of the plurality of lenses and the light emitting elements is approximately 2.51 mm to approximately 2.74 mm.

4. An image forming apparatus according to claim 1, further comprising a third lens, which is positioned between the first and the second lenses, and wherein the light beam that is emitted from the first light emitting element passes through the first and third lenses.

5. An image forming apparatus according to claim 4, wherein the first light emitting element is positioned on a midpoint between the optical axes of the first and the third lenses.

6. An image forming apparatus according to claim 5, wherein the first and third lenses are adjacent to one another and the second and third lenses are adjacent to one another.

7. An image forming apparatus according to claim 4, wherein the second light emitting element is on an optical axis of the third lens.

8. An image forming apparatus according to claim 1, wherein the light beam that is emitted from the second light emitting element passes through the first and second lenses.

9. An image forming apparatus according to claim 1, wherein the second light emitting element is located at a distance of the pitch of the plurality of lenses from the optical axis of the first and second lenses of the plurality of lenses and the light beam emitted from the second light emitting element passes through the first and second lenses.

10. An image forming apparatus according to claim 1, wherein each of the plurality of lenses is a cylindrical lens having a two-dimensional distribution of refractive index in a radial direction.

11. An image forming apparatus according to claim 1, wherein the plurality of light emitting elements are arranged in a line at a pitch of approximately 0.021 mm.

12. An image forming apparatus according to claim 1, wherein the pitch of the plurality of lenses from the optical axis is approximately 0.4 mm to approximately 0.6 mm.

13. An image forming apparatus according to claim 1, wherein a diameter of each of the plurality of lenses is approximately 0.37 mm to 0.56 mm.

14. An image forming apparatus comprising:

a photosensitive member;

a light source comprising a plurality of light emitting elements arranged in a line extending in a main-scanning direction;

a lens array comprising a plurality of lenses that are arranged in three lines extending in the main-scanning direction such that the lenses of the neighboring lines are offset by one another, the lens array being for imaging light emitted from the light source to form an erect equi-magnified image on a surface of the photosensitive member, wherein the light source is arranged above a center of the lens array in the sub-scanning direction, viewed from a direction of optical axes of the lenses, and wherein the light source is located on a longitudinal center line of a middle line of the plurality of lenses, wherein the surface of the photosensitive member is located between an image surface on which light that is emitted from a first light emitting element located away in one way of the main-scanning direction from an optical axis of a lens of the plurality of lenses arranged in a center line with respect to the sub-scanning direction at a distance of a half of a pitch of the plurality of lenses in the main-scanning direction and that passes through the lens is focused and an image surface on which light that is emitted from a second light emitting element located away in the way of the main-scanning direction from the optical axis of the lens of the plurality of lenses at a distance of the pitch of the plurality of lenses in the main-scanning direction is focused.

15. An image forming apparatus according to claim 14, wherein a distance between end surfaces of the plurality of lenses nearer the photosensitive member and the surface of the photosensitive member is equal to a distance between end surfaces of the plurality of lenses nearer the plurality of light emitting points and the plurality of light emitting points.

* * * * *